US011300371B2

(12) United States Patent
Mironets

(10) Patent No.: US 11,300,371 B2
(45) Date of Patent: Apr. 12, 2022

(54) SELF-REGULATING HEAT EXCHANGER

(71) Applicant: Hamilton Sundstrand Corporation, Charlotte, NC (US)

(72) Inventor: Sergey Mironets, Charlotte, NC (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 0 days.

(21) Appl. No.: 16/786,704

(22) Filed: Feb. 10, 2020

(65) Prior Publication Data

US 2020/0182565 A1 Jun. 11, 2020

Related U.S. Application Data

(63) Continuation of application No. 14/598,607, filed on Jan. 16, 2015, now Pat. No. 10,557,671.

(51) Int. Cl.

| | |
|---|---|
| ***F28F 13/00*** | (2006.01) |
| ***F28F 13/08*** | (2006.01) |
| ***F28F 3/02*** | (2006.01) |
| ***F28F 27/00*** | (2006.01) |
| ***F28F 13/12*** | (2006.01) |

(52) U.S. Cl.

CPC ..... *F28F 13/08* (2013.01); *F28F 3/022* (2013.01); *F28F 3/027* (2013.01); *F28F 13/12* (2013.01); *F28F 27/00* (2013.01); *F28F 2255/04* (2013.01)

(58) Field of Classification Search

CPC .. F28F 13/08; F28F 13/12; F28F 27/00; F28F 2255/04; F28F 3/022; F28F 3/027

See application file for complete search history.

(56) References Cited

U.S. PATENT DOCUMENTS

| | | | | |
|---|---|---|---|---|
| 5,010,643 | A * | 4/1991 | Zohler | B21C 37/207 165/133 |
| 5,699,855 | A | 12/1997 | Mitsuhashi | |
| 6,128,188 | A | 10/2000 | Hanners | |
| 2008/0099193 | A1* | 5/2008 | Aksamit | H01L 23/467 165/300 |
| 2009/0314265 | A1 | 12/2009 | Freese, V | |
| 2012/0261106 | A1 | 10/2012 | Kelly | |

FOREIGN PATENT DOCUMENTS

| | | | | |
|---|---|---|---|---|
| JP | 59231397 A | * | 12/1984 | F28F 13/12 |
| JP | H03294033 A | * | 12/1991 | F28F 1/40 |

* cited by examiner

*Primary Examiner* — Harry E Arant

(74) *Attorney, Agent, or Firm* — Locke Lord LLP; Daniel J. Fiorello; Gabrielle L. Gelozin

(57) ABSTRACT

A heat exchanger includes a flow channel operatively connecting a channel inlet to a channel outlet to channel fluid to flow therethrough. The flow channel is defined at least partially by a shape change material. The shape change material changes the shape of the flow channel based on the temperature of the shape change material. The shape change material can include a shape-memory alloy, for example. The shape-memory alloy can include at least one of a nickel-titanium alloy (NiTi), Cu—Al—(X), Cu—Sn, Cu—Zn—(X), In—Ti, Ni—Al, Fe—Pt, Mn—Cu, or Fe—Mn—Si.

5 Claims, 3 Drawing Sheets

SELF-REGULATING HEAT EXCHANGER

CROSS-REFERENCE TO RELATED APPLICATION

This application is a divisional application of U.S. patent application Ser. No. 14/598,607 filed on Jan. 16, 2015, which is incorporated herein by reference in its entirety.

BACKGROUND

1. Field

The present disclosure relates to heat exchangers, more specifically to plate fin heat exchangers.

2. Description of Related Art

Plate fin heat exchangers include plates that define flow channels for a first fluid to flow therethrough. A fin layer can be disposed in thermal communication with each plate and allow a second fluid to flow through the fin layer to thereby draw heat from the fins, ultimately cooling the first fluid in the plate. Traditional plate fin heat exchangers require the designer to balance pressure drop with thermal efficiency, the calculus of which changes with changing operational temperatures. However, traditional heat exchangers have no means by which to adjust pressure drop or thermal efficiency responsive to changing operational temperatures.

Such conventional methods and systems have generally been considered satisfactory for their intended purpose. However, there is still a need in the art for improved heat exchanger systems. The present disclosure provides a solution for this need.

SUMMARY

A heat exchanger includes a flow channel operatively connecting a channel inlet to a channel outlet to channel fluid to flow therethrough. The flow channel is defined at least partially by a shape change material. The shape change material changes the shape of the flow channel based on the temperature of the shape change material. The shape change material can include a shape-memory alloy, for example. The shape-memory alloy can include at least one of a nickel-titanium alloy (NiTi), Cu—Al—(X), Cu—Sn, Cu—Zn—(X), In—Ti, Ni—Al, Fe—Pt, Mn—Cu, or Fe—Mn—Si.

The heat exchanger can further include a plate defining a second flow channel operatively connecting a second channel inlet to a second channel outlet to channel a second fluid to flow therethrough, wherein the flow channel is mounted in thermal communication with the plate. The flow channel can be sandwiched between two plates.

The flow channel can be configured to have a first shape at a first temperature and a second shape at a second temperature higher than the first temperature, wherein the second shape provides increased thermal efficiency compared to the first shape.

The flow channel can include an aligned fin shape in the first shape and the second shape can be defined by a step-wise shift of the aligned fin shape at segmented portions of the flow channel to provide increased thermal efficiency to regulate temperature of the heat exchanger. In certain embodiments, the first shape can be a tubular shape and the second shape can be a swirl shape.

The flow channel can be defined by a plurality of wires, at least one of which including the shape change material. In certain embodiments, the flow channel can be defined by a mesh of shape change wires.

In certain embodiments, the flow channel can be additively manufactured. For example, the flow channel can be formed using laser powder-bed fusion.

These and other features of the systems and methods of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION

Figure 1A:
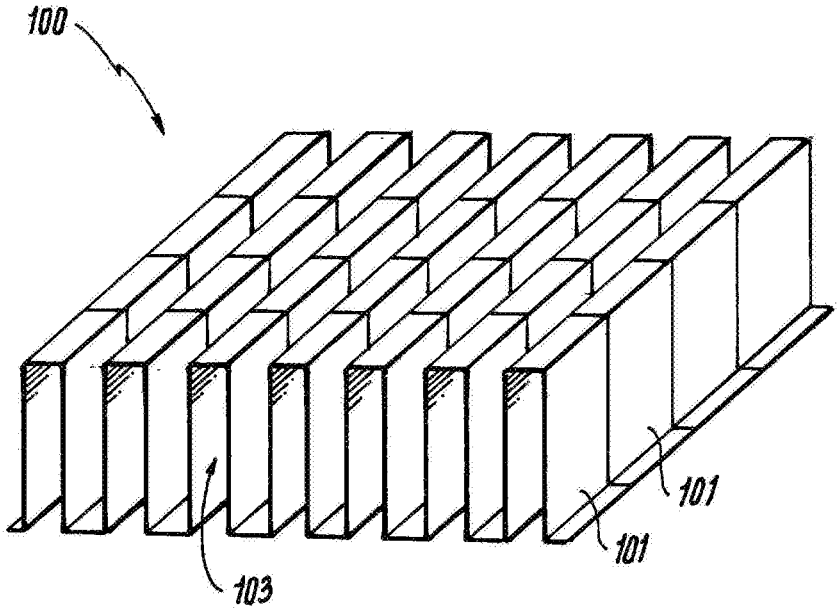
FIG. 1A is a perspective view of an embodiment of a flow channel of a heat exchanger in accordance with this disclosure, showing the flow channel in a first shape.

Reference will now be made to the drawings wherein like reference numerals identify similar structural features or aspects of the subject disclosure. For purposes of explanation and illustration, and not limitation, an illustrative view of an embodiment of a flow channel of a heat exchanger in accordance with the disclosure is shown in FIGS. 1A and is designated generally by reference character 100. Other embodiments and/or aspects of this disclosure are shown in FIGS. 1B-4C. The systems and methods described herein can be used to optimize thermal efficiency of a heat exchanger.

Figure 1B:
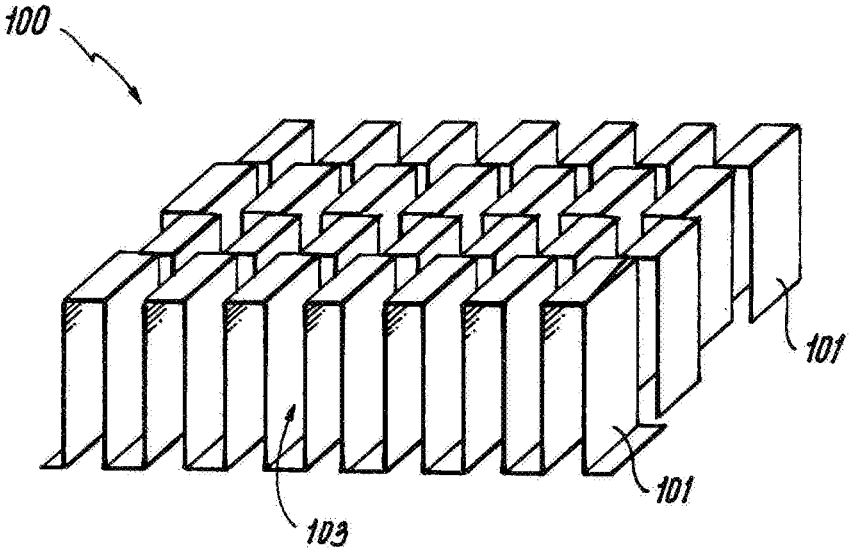
FIG. 1B is a perspective view of the flow channel of FIG. 1A, showing the flow channel in a second shape.
Figure 1C:
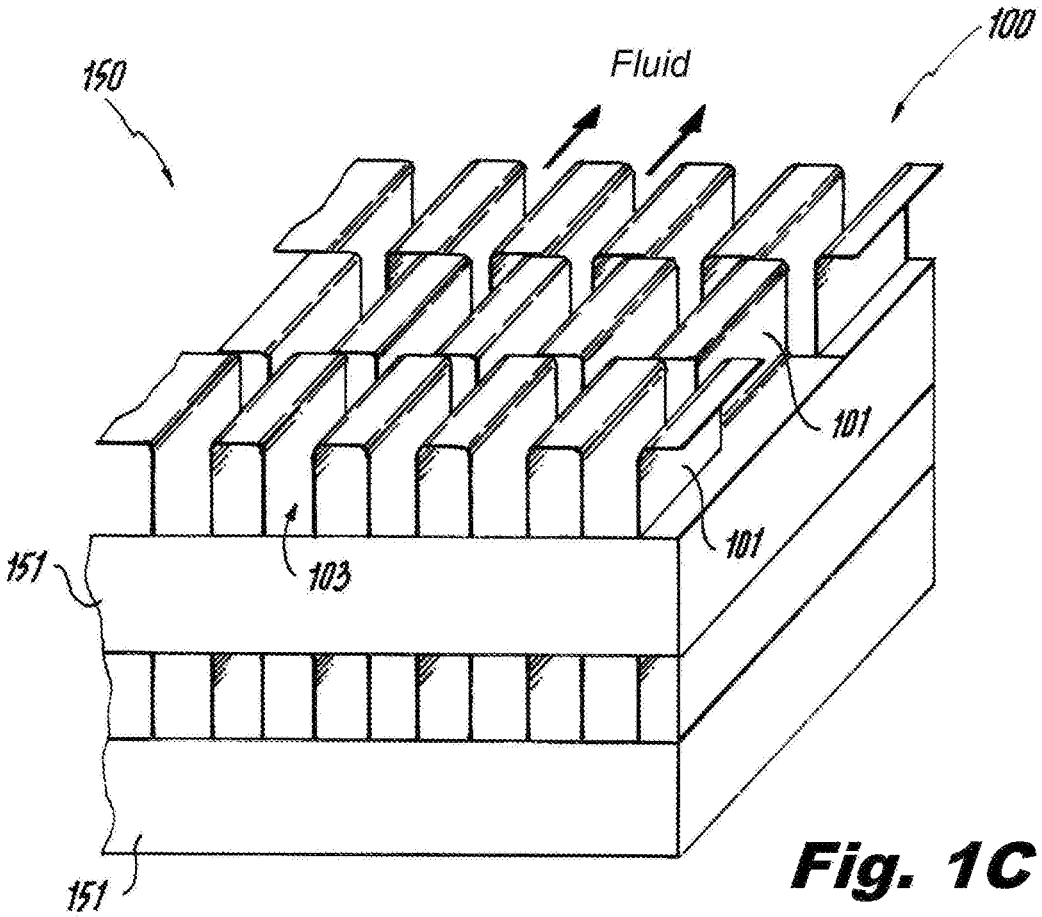
FIG. 1C is a perspective view of an embodiment of a plate fin heat exchanger in accordance with this disclosure, showing the flow channel of FIG. 1A disposed thereon in the second shape.

Referring generally to FIGS. 1A-1C, a heat exchanger (e.g., plate fin heat exchanger 150 shown in FIG. 1C) includes a flow channel 100 for a fluid to flow therethrough and defined at least partially by a shape change material. The shape change material changes a shape of the flow channel 100 based on a temperature of the shape change material. The shape change material can include a shape-memory alloy. The shape-memory alloy can include at least one of a nickel-titanium alloy (NiTi), Cu—Al—(X), Cu—Sn, Cu—Zn—(X), In—Ti, Ni—Al, Fe—Pt, Mn—Cu, Fe—Mn—Si, or any other suitable shape-memory material.

The heat exchanger 150 can further include one or more plates 151 defining a second flow channel for a second fluid to flow therethrough. As shown in FIG. 1C, the flow channel 100 can be mounted in thermal communication with plates 151 and/or sandwiched between two plates 151. Any other suitable number of plates and/or channels can be used.

The flow channel 100 can include a first shape at a first temperature and a second shape at a second temperature higher than the first temperature. It is contemplated that the second shape provides increased thermal efficiency compared to the first shape, e.g., by increasing the effective surface area in the flow channel 100. However, those skilled in the art will readily appreciate that this can also be used in reverse, e.g., using a more thermally efficient shape for lower temperatures if needed for a given application.

As shown in FIG. 1A the first shape can include an aligned fin shape 103 in a flow-wise direction (e.g., forming step-like rectangular passages). Referring to FIG. 1B, the second shape can be defined by a step-wise shift of the aligned fin shape at segmented portions 101 thereof to provide increased thermal efficiency to regulate temperature of the heat exchanger 150. It is contemplated that the reverse order of shapes can be utilized.

As shown, in the first shape, the segmented portions 101 are aligned, forming smooth rectangular channels. In the second shape, the segmented portions 101 are misaligned in the flow-wise direction, which increases the pressure drop across the flow channels 100 but increases thermal efficiency.

Figure 2A:
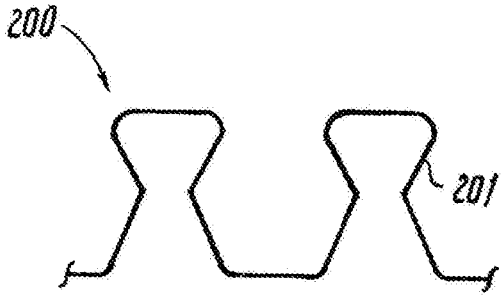
FIG. 2A is a schematic cross-sectional view of an embodiment of a flow channel of a heat exchanger in accordance with this disclosure, showing the flow channel in a first shape.
Figure 2B:
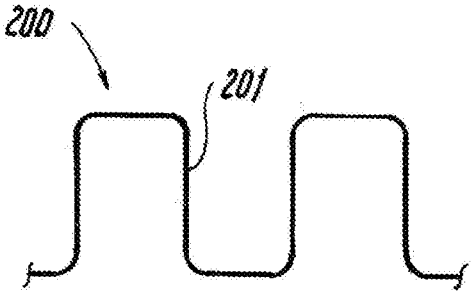
FIG. 2B is a cross-sectional view of the flow channel of FIG. 2A, showing the flow channel in a second shape.

Referring to FIGS. 2A and 2B, a flow channel 200 can include fins 201 configured to change in cross-sectional shape made at least partially of a shape change material as described above. For example, one or more of the segmented portions 101 of flow channel 100 can include a cross-sectionally shape changing fins 201. It is also contemplated that fins 201 can be continuous flow channels without segmented portions 101.

As shown in FIG. 2A, the fins 201 of flow channel 200 can include a first cross-sectional shape with bent sides. Referring to FIG. 2B, when temperature increases, the sides of fins 201 can straighten, increasing cross-sectional area within the sides. It is also contemplated that the first cross-sectional shape can include straight sides of fins 201 and the second cross-sectional shape can include bent sides of fins 201.

Figure 3A:
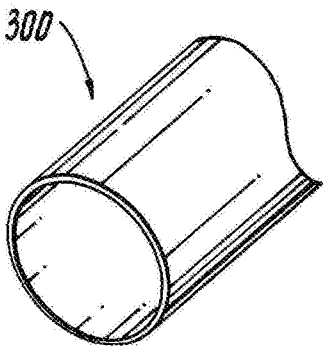
FIG. 3A is a perspective view of an embodiment of a cylindrical flow channel of a heat exchanger in accordance with this disclosure, showing the flow channel in a first shape.
Figure 3B:
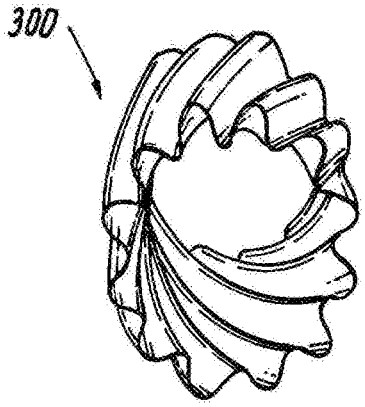
FIG. 3B is a cross-sectional view of the flow channel of FIG. 3A, showing the flow channel in a second shape.

Referring to FIG. 3A, in certain embodiments, a flow channel 300 is made at least partially of a shape change material as described above and can include a first cross-sectional shape defining a tubular shape. Referring to FIG. 3B, the second cross-sectional shape of flow channel 300 can include a swirl shape (e.g., a helical shape) at the second temperature. The swirl shape can create flow turbulence and increase the total surface area for a more efficient heat transfer coefficient without significant increase in pressure drop.

Figure 4A:
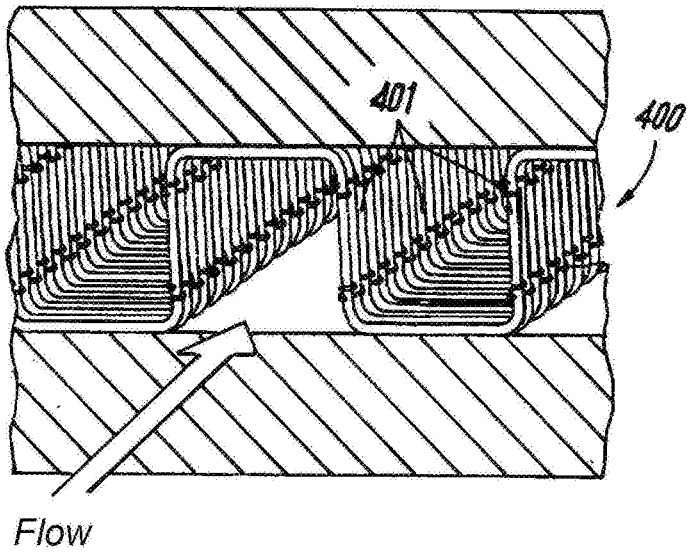
FIG. 4A is a cross-sectional view of an embodiment of a flow channel of a heat exchanger in accordance with this disclosure, showing the flow channel in a first shape defined by a plurality of wires.
Figure 4B:
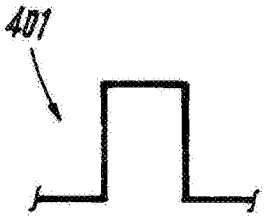
FIG. 4B is a cross-sectional view of a wire of the flow channel of FIG. 4A, showing the wire in a first shape.
Figure 4C:
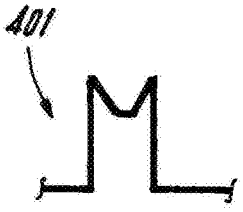
FIG. 4C is a cross-sectional view of FIG. 4B, showing the wire in a second shape.

Referring to FIG. 4A, a flow channel 400 can be defined by a plurality of wires 401, at least one of which including the shape change material as described above. In certain embodiments, the flow channel 400 can be defined by a mesh of shape change wires 401. As shown in FIG. 4B, one or more of the wires 401 can have a first shape (e.g., a step-like rectangular shape) and can change to as second shape (e.g., a partially bent portion) at the second temperature.

It is envisioned that the shape change material can be selected to allow for the process of changing shape to be reversible when the heat exchanger is cooled. It is also contemplated that the shape change material can be selected to make the process of changing shape can be irreversible.

In certain embodiments, the flow channels 100, 200, 300, 400 as described herein can be additively manufactured. For example, the flow channel 100, 200, 200, 400 can be formed using laser powder-bed fusion. Any other suitable method of manufacturing is contemplated herein.

The above described systems and methods allow for a self-adjusting heat exchanger with an optimized Nusselt number. The Nusselt number characterizes the ratio of convective to conductive heat transfer across a surface. A high Nusselt number is indicative of efficient transfer of heat from a core structure to a coolant. Also, the above described systems and methods allow for the pumping power needed to drive the coolant through the structure to be modified with shape change.

The methods and systems of the present disclosure, as described above and shown in the drawings, provide for heat exchangers with superior properties including self-regulating flow channels. While the apparatus and methods of the subject disclosure have been shown and described with reference to embodiments, those skilled in the art will readily appreciate that changes and/or modifications may be made thereto without departing from the spirit and scope of the subject disclosure.

What is claimed is:

1. A heat exchanger, comprising:

a flow channel operatively connecting a channel inlet to a channel outlet to channel fluid to flow therethrough and defined at least partially by a shape change material, wherein the shape change material changes a shape of the flow channel based on a temperature of the shape change material, wherein the flow channel includes a first shape at a first temperature and a second shape at a second temperature higher than the first temperature, wherein the second shape provides increased thermal efficiency compared to the first shape, wherein the first shape includes a smooth, non-corrugated tubular shape configured to induce laminar flow, wherein the second shape includes a non-tubular corrugated swirl shape configured to induce turbulent flow.

2. The heat exchanger of claim 1, wherein the shape change material includes a shape-memory alloy.

3. The heat exchanger of claim 2, wherein the shape-memory alloy includes at least one of a nickel-titanium alloy (NiTi), Cu—Al—(X), Cu—Sn, Cu—Zn—(X), In—Ti, Ni—Al, Fe—Pt, Mn—Cu, or Fe—Mn—Si.

4. The heat exchanger of claim 1, wherein the flow channel is additively manufactured.

5. The heat exchanger of claim 1, wherein the flow channel is formed using laser powder-bed fusion.

* * * * *